US006884493B2

(12) United States Patent
Magee et al.

(10) Patent No.: US 6,884,493 B2
(45) Date of Patent: Apr. 26, 2005

(54) PATTERNED CARPET AND METHOD

(75) Inventors: Ronald Magee, LaGrange, GA (US); James C. Bridges, LaGrange, GA (US)

(73) Assignee: Milliken & Company, Spartanburg, SC (US)

( * ) Notice: Subject to any disclaimer, the term of this patent is extended or adjusted under 35 U.S.C. 154(b) by 164 days.

(21) Appl. No.: 09/876,912

(22) Filed: Jun. 8, 2001

(65) Prior Publication Data

US 2002/0012764 A1 Jan. 31, 2002

Related U.S. Application Data

(60) Provisional application No. 60/241,170, filed on Oct. 17, 2000, and provisional application No. 60/211,295, filed on Jun. 13, 2000.

(51) Int. Cl.[7] ..... B32B 5/02; D06P 5/22; B41J 2/01; B41J 3/407

(52) U.S. Cl. ..... 428/175; 428/174; 428/196; 8/445; 8/929; 347/106; 347/101; 347/105

(58) Field of Search ..... 347/101, 102, 347/104, 105, 106, 107, 1; 8/445, 499, 929; 442/181; 428/174, 175, 156, 195, 196, 92, 93, 94, 97

(56) References Cited

U.S. PATENT DOCUMENTS

| | | | | |
|---|---|---|---|---|
| 4,141,231 A | | 2/1979 | Kudlich | 68/205 |
| 4,170,883 A | | 10/1979 | Varner | 68/205 |
| 4,188,216 A | * | 2/1980 | Blumenaus | 430/22 |
| 4,286,003 A | | 8/1981 | Higgins et al. | 428/95 |
| 4,336,753 A | | 6/1982 | Vidalis | 101/127 |
| 4,341,098 A | | 7/1982 | Otting | 68/205 |
| 4,397,900 A | | 8/1983 | Higgins | 428/95 |
| 4,485,508 A | | 12/1984 | Otting | 8/151 |
| 4,501,038 A | | 2/1985 | Otting | 8/151 |
| 4,522,857 A | | 6/1985 | Higgins | 428/95 |
| 4,547,921 A | | 10/1985 | Otting et al. | 8/151 |

(Continued)

FOREIGN PATENT DOCUMENTS

| | | | | |
|---|---|---|---|---|
| DE | 24 12 030 | | 10/1975 | |
| DE | 27 33 697 | | 3/1978 | |
| EP | 0 057 513 | | 8/1982 | |
| EP | 0 123 367 | | 10/1984 | |
| EP | 0 306 568 | | 3/1989 | |
| FR | 2 271 878 | | 12/1975 | |
| GB | 2 042 422 | | 9/1924 | |
| GB | 2 022 017 | | 12/1979 | |
| GB | 2 187 419 | | 9/1987 | |
| WO | 80/00145 | | 2/1980 | |
| WO | 81/01161 | | 4/1981 | |
| WO | WO 9919557 | A1 * | 4/1999 | D06N/7/00 |
| WO | 99/19557 | | 4/1999 | |
| WO | 02/102582 | A3 | 12/2002 | |
| WO | 02/102582 | | 12/2002 | |
| WO | 02/102582 | A2 | 12/2002 | |

OTHER PUBLICATIONS

L. Shoskes, Contract Carpeting, 1974, Watson–Guptill Publications, pp. 32–46.*

*Primary Examiner*—Cheryl A. Juska
(74) *Attorney, Agent, or Firm*—Terry T. Moyer; Daniel R. Alexander

(57) ABSTRACT

Color, pattern, design, and/or the like is applied by means of a jet dye process, or any other secondary or post pattern application process, including but not exclusively, silk screen printing and rotary printing, etc., to a carpet substrate, where the yarn in the carpet is all white (no dye applied) or where the yarn is pre-dyed with a single or multiple colors or where the yarn is treated chemically. The carpet can, for example, be made with any conventional loom weaving process or hand weaving process, for example Wilton, Axminster, spool, spool gripper, and Chenille looms, hand gun tufted, or any other conventional method.

6 Claims, 11 Drawing Sheets

U.S. PATENT DOCUMENTS

| | | | | |
|---|---|---|---|---|
| 4,574,413 | A | | 3/1986 | Otting et al. ..... 8/149.1 |
| 4,576,020 | A | | 3/1986 | Thurman et al. ..... 68/205 |
| 4,647,484 | A | | 3/1987 | Higgins ..... 428/40 |
| 4,655,784 | A | | 4/1987 | Rahman ..... 8/148 |
| 4,676,078 | A | | 6/1987 | Ramsey ..... 68/205 |
| 4,766,745 | A | | 8/1988 | Johnston et al. ..... 68/200 |
| 4,849,768 | A | | 7/1989 | Graham ..... 346/1.1 |
| 4,905,592 | A | | 3/1990 | Sorel ..... 101/123 |
| 4,928,391 | A | | 5/1990 | Higgins et al. ..... 30/293 |
| 4,991,307 | A | | 2/1991 | Higgins ..... 33/526 |
| 5,228,161 | A | | 7/1993 | Scatizzi ..... 8/151 |
| 5,381,592 | A | | 1/1995 | Higgins ..... 28/100 |
| 5,404,158 | A | | 4/1995 | Carlotta et al. ..... 347/32 |
| 5,425,389 | A | | 6/1995 | Johnson, Jr. ..... 137/1 |
| 5,443,881 | A | | 8/1995 | Higgins et al. ..... 428/93 |
| 5,457,845 | A | | 10/1995 | Higgins et al. ..... 15/302 |
| 5,540,968 | A | | 7/1996 | Higgins ..... 428/95 |
| 5,545,276 | A | | 8/1996 | Higgins ..... 156/79 |
| 5,567,257 | A | | 10/1996 | Higgins et al. ..... 156/72 |
| 5,728,841 | A | | 3/1998 | Shigeno et al. ..... 521/40 |
| 5,929,145 | A | | 7/1999 | Higgins et al. ..... 524/69 |
| 5,948,500 | A | | 9/1999 | Higgins ..... 428/95 |
| 6,001,137 | A | | 12/1999 | Alfekri et al. ..... 8/445 |
| 6,142,619 | A | * | 11/2000 | Miura et al. ..... 347/101 |
| 6,162,748 | A | | 12/2000 | Schilling et al. ..... 442/226 |
| 6,203,881 | B1 | | 3/2001 | Higgins ..... 428/95 |
| 6,468,623 | B1 | | 10/2002 | Higgins ..... 428/95 |
| 6,586,053 | B1 | | 7/2003 | Brown et al. ..... 427/389.9 |
| 2002/0024549 | A1 | * | 2/2002 | Miura et al. ..... 347/15 |
| 2002/0034607 | A1 | * | 3/2002 | Stoyles ..... 428/95 |
| 2003/0114062 | A1 | | 6/2003 | Scott et al. ..... 442/181 |

* cited by examiner

Low Profile Loop, Sisal-Like Looks

Low Profile Loop, Sisal-Like Looks

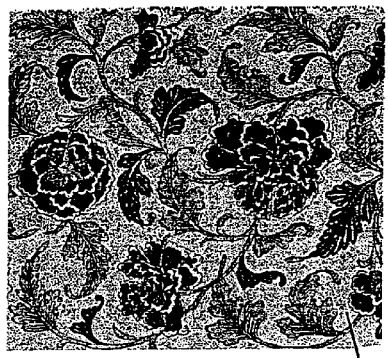
FIG. 18
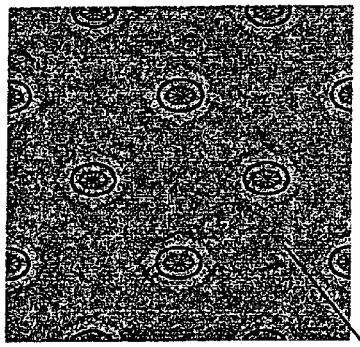
FIG. 17
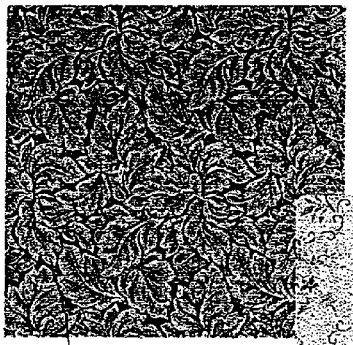
FIG. 19
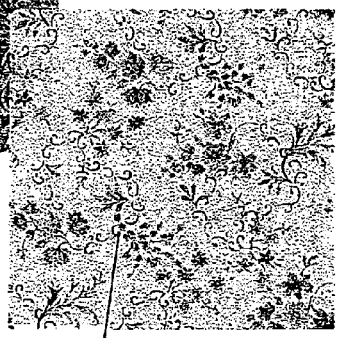
FIG. 20
Designs of Various Styles applied to Un-dyed Sisal- like Carpet
Un-Dyed Sisal- Like Carpet
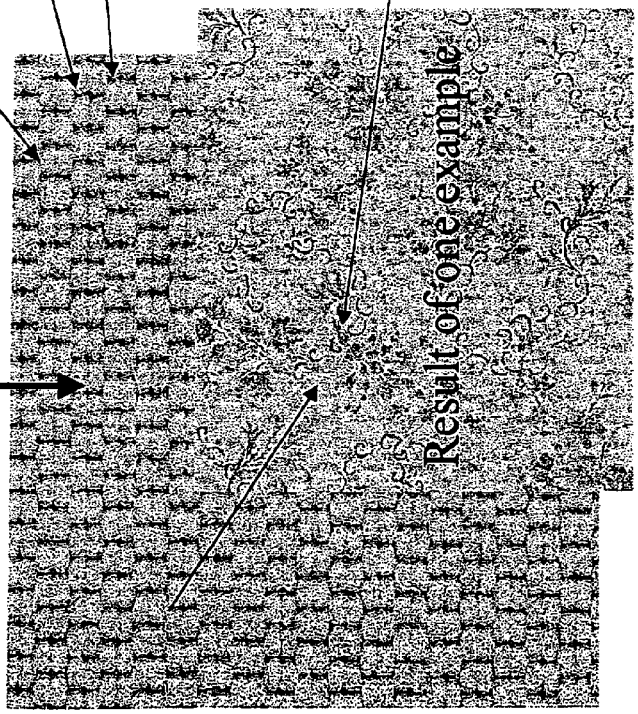
FIG. 21
FIG. 16

Yarns Can be treated with Various Chemical or Physical Treatments.

In the illustration below the colors are used as a code to show the random type pattern created by the different yarns, the actual carpet would be all white. The variation in the yarns would only become visible after the post dye application of pattern and then it would show as a subtle effect throughout the carpet

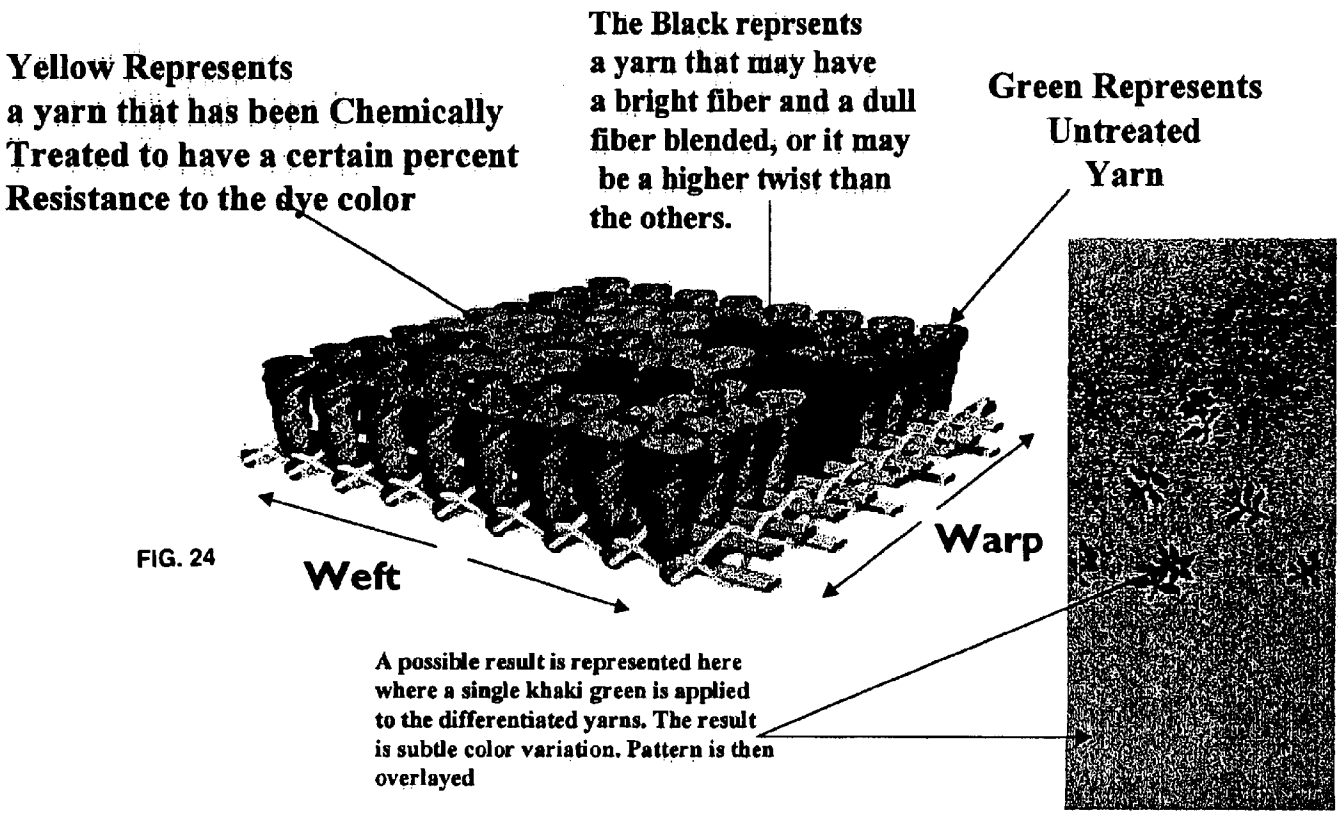

FIG. 24

FIG. 25

PATTERNED CARPET AND METHOD

REFERENCE TO RELATED APPLICATIONS

This application claims priority to and benefit of U.S. Provisional Patent Application Ser. No. 60/241,170, filed on Oct. 17, 2000, and priority to and benefit of U.S. Provisional Patent Application Ser. No. 60/211,295, filed on Jun. 13, 2000, both of which are hereby incorporated by reference.

FIELD OF THE INVENTION

The present invention is directed to applying color, pattern, design, and/or the like by means of a jet dye process, or any other secondary or post pattern application process, including but not exclusively transfer printing, silk screen printing and rotary printing, etc., to preferably a woven carpet, where the yarn in the carpet is all white or a light shade or color (no dye applied) or where yarn is treated chemically or where the yarn is pre-dyed with a single or multiple colors. In one embodiment, the preferred woven carpet has a sisal-like look or appearance. The woven carpet can be made with a conventional loom weaving process or hand weaving process, for example Wilton, Axminster, Spool, Spool Gripper and Chenille looms, hand gun tufted or any other conventional carpet weaving method or methods.

BACKGROUND OF THE INVENTION

Conventional hand or machine woven sisal mats, carpets and rugs are hand painted with acrylic paints to produce images thereon or made with limited color creel which allows for very limited color in the woven sisal.

Also, there are problems with the old carpet weaving conventions. Creating designs using the old loom weaving methods are three-fold.

1. The fineness and detail of the design (dots per inch) are tied into and dependent upon the construction of the weave.
2. Aspect ratio of dots per inch (DPI) is arbitrary and makes it difficult to turn designs at 90° on a carpet web.
3. The same design cannot be created on multiple weave constructions without design modification or in essence a new design for each construction nor can the same design be run on multiple weave constructions consecutively without stopping the loom. For example, the same design cannot be created on a woven loop or cut-loop construction in the same run without stopping the loom.

Detailed Explanation of the Three-Fold Problems

1) The fineness and detail of the design. When conventional carpets are woven, the design is created by locking pre-colored (Skein Dyed) yarn into a warp and weft weaving construction. The design or face pile and backing are literally created at one and the same time as the loom operates. Although the results are a beautiful carpet, there is a significant draw back, in that if one wishes to make the carpet in a lower price point (looser construction, lighter weight, etc.) then the aesthetic detail of the design will deteriorate significantly. Looser, cheaper, lighter, and lower price point are all common terms used when referring to a carpet construction of approximately 22 to 24 oz in weight, 2/56 yarn count, 0.25 inch pile height, and 7 pick/ends by 5 row construction.

To create a lower cost carpet, the weaver must reduce the materials used in the carpet, in other words a looser construction. In so doing, the dots per inch are also reduced and the design detail is greatly effected. With conventional carpets, "The cheaper the carpet the cheaper looking it is."

A typical, low priced woven carpet construction, is about 5 rows by 7 pick/ends, or 35 dots per inch. Therefore, the very low dots per inch (DPI) matrix gives the design motifs a ragged or blocky look because the dots per inch are so large.

The final result is a product with less market appeal, "Cheap Looking Carpet."

2) Aspect ratio of dots per inch is arbitrary. This is again an outcome of the design being locked into the weave of conventional carpet. The standard warp setting on a loom is fixed, typically 7 ends (picks) per inch. The weft is variable, say 5, 6, 7, 8, 9, 10 rows per inch. Therefore, to change the density of the carpet, (thicker or thinner, more or less expensive, etc.) you would create the weave thus, 5 rows by 7 ends (35 DPI) which would be an inexpensive carpet or, 10 rows by 7 ends, (70 DPI) which would be a very expensive carpet. Very expensive, good quality, high end, and higher price point are all common terms for a woven carpet construction which is approximately 32–36 oz in weight, 2/56 yarn count, 0.50 inch pile height, and 7×8 to 7×10 rows and picks per inch.

The problem is, there is an aspect ratio in the dots per inch. They are not square dots but rectangles, for example a 7 row by 7 ends is a square dot, but a 10 row by 7 ends is a rectangular dot. This causes problems when weaving for example, a rug.

When the aspect ratio of the dots is a rectangle, the rug or design can only be woven in one direction. To turn the rug or design at 90° to maximize the use of the carpet web, would distort the design in either the length or width directions. The only dot matrix that might work is the 7×7 square dot but then one would be tied into only one price point when weaving rugs.

The same design cannot be created on multiple conventional weave constructions. Since the design and conventional weave construction are inseparable you cannot create the same design on different price points (constructions, heavier, lighter, etc. as described above). Obviously, if a design is created on a 10×7 DPI weave, it cannot be the same when transferred onto a 5×7 DPI weave, because of the loss of detail, only a facsimile can be made.

If one is weaving carpet on a loom, one can only weave a single construction at a time. It is not possible to make running changes to the construction of a woven carpet, either to change its weight or texture from cut to loop pile. In other words, it is possible only to make one price point (construction, heavier, lighter, etc.) or pile type of conventional carpet at a time on one loom. To alter the construction or pile type, the loom must be stopped and adjusted, thus creating significant inefficiencies.

SUMMARY OF THE INVENTION

The new method or carpet of the present invention eliminates or addresses all of the three-fold problems previously mentioned and takes advantage of the best of the old weaving methods, namely the superior carpet construction of a woven verses a tufted carpet.

1) The fineness and detail of the design. In accordance with one embodiment of the present invention, a woven white yarn carpet is passed under a jet-dye patterning applicator by means of a conveyor. The carpet passes under the jet-dye gunbars of a given number. Each gunbar or colorbar holds a different dye color. Using design software, the jets shoot dye onto the carpet and form designs and patterns of infinite variety and color. The dyes are then fixed, dried and finished.

The advantage of the present invention is that the design or patterning is a separate and independent process, from the construction (weave) of the carpet itself. Design dots per inch (DPI) can now be determined independently of the carpet (weave DPI) so that woven carpets of various weights, construction thickness, etc., can have designs applied to them that are of a consistently fine detail. For example, a design can now be created using a DPI of for example, 10×10, 20×20, or 40×40 and applied to a carpet with a construction of, for example, only 5×7 and the design will no longer look cheap and ragged. Also, a DPI of 20×20 (400) or 40×40 (1600), cannot be made on a conventional weaving loom. 16×7 or 112 DPI is the maximum for conventional weaving looms.

2) Aspect ratio of dots per inch is arbitrary. Since the design application of the present invention is independent of the carpet construction, the aspect ratio can be a square, for example 20×20 DPI or10×10 DPI. Therefore designs of all types, including rugs, runner and borders can be turned at 90° to maximize the utilization of the carpet base, without design distortion.

3) The same design can be created on multiple weave constructions. Since the design application of the present invention is independent of the carpet construction, the exact same design can be placed on any carpet construction or any pile type (loop or cut-pile or combination) and it can be done consecutively with multiple construction and pile types in the same run without stopping the design applicator (jet dye machine), thus significantly improving efficiencies over the old method.

BRIEF DESCRIPTION OF THE DRAWINGS

FIG. 8 is a photographic top view representation of a sisal-like woven, patterned carpet, rug, or the like.

FIG. 16 is a photographic top view illustration of an un-dyed sisal-like carpet substrate.

FIGS. 17–20 are respective top view photographic representations of patterned sisal-like products made from the substrate of FIG. 16.

FIG. 21 is an enlarged top view photographic illustration of the patterned sisal-like product of FIG. 20.

FIGS. 23 and 24 are respective schematic perspective view representations of cut pile woven products.

FIG. 25 is a top view photographic representation of one example of a patterned product produced from the substrate of FIG. 24.

DETAILED DESCRIPTION OF THE INVENTION

In accordance with at least one embodiment of the present invention, the white woven substrate may be formed of 2 ply yarn (2/56 means 56 yards to the oz), 100% wool, 100% nylon or other post dyeable synthetic and/or natural yarn or blend such as 80% nylon, 20% wool, or the like, and have a weave construction of 7×4.5, 7×5, 7×6, 7×7, 7×8, 7×9, 7×10, 7×12, etc., and may be woven from a white yarn or a solid colored yarn which can be dyed or printed (over dyed or over printed) to produce the final effect. For example, when a white yarn is used to produce a white woven carpet substrate, the background color of the rug is printed along with the design or pattern if that color is not white. Alternatively, if the yarn is a dyed or colored yarn (solution dyed, yarn dyed, naturally colored, or the like) then the design or pattern is printed thereon, but the background color is already created by the yarn itself. It is preferred to use white or a light off white color yarn.

Figure 1:
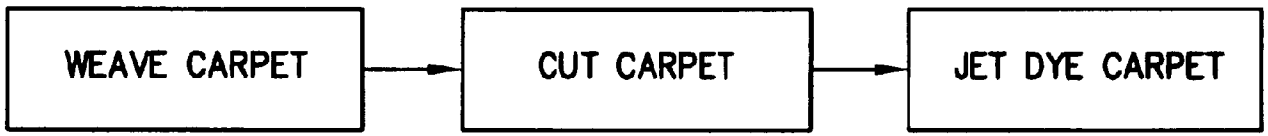
FIG. 1 is a schematic view illustrating one embodiment of the process of the present invention.

With respect to FIG. 1 of the drawings, and in accordance with one embodiment of the present invention, the carpet substrate is woven, the carpet substrate is cut into selected pieces, tiles, or the like, then each of the cut pieces is dyed or printed.

Figure 2:
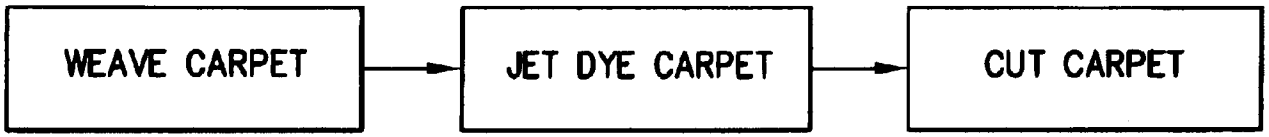
FIG. 2 is a schematic view representing another embodiment of the process of the present invention.

With reference to FIG. 2 of the drawings and in accordance with another embodiment of the present invention, the carpet substrate is woven, then the substrate is jet dyed with particular colors, patterns, designs, and/or the like, then particular rugs, area rugs, runners, and the like are cut from the woven dyed carpet.

Figure 3:
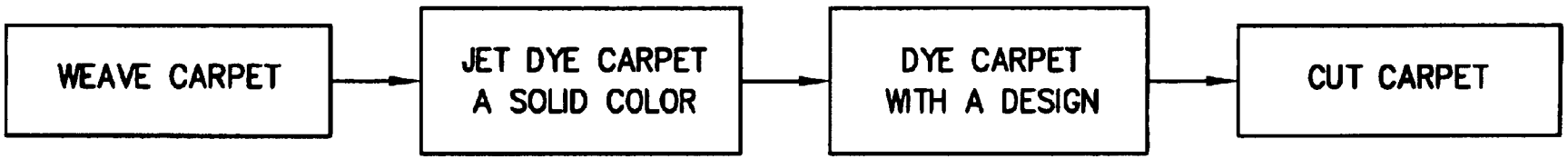
FIG. 3 is a schematic view representing another embodiment of the process of the present invention.

Although it is preferred to dye the background color and design or pattern of the rug or carpet in a single step, as shown in FIGS. 1 and 2 of the drawings, in accordance with another embodiment of the present invention as shown in FIG. 3, the carpet substrate is woven, the carpet is dyed with a, for example, solid background color, then it is dyed or printed with a pattern or design, and then it is cut into rugs. Alternatively, the undyed woven substrate can have the pattern applied to it with dyes that have resist chemistry, then the background shade can be applied in line with an overflow applicator or the background shade can be applied as a separate step in a "Beck Dye" applicator.

If the end product is, for example, an area rug, one can apply an edging, ribbing, piping or surging by gluing, sewing, or otherwise attaching the edging thereto.

Figure 4:
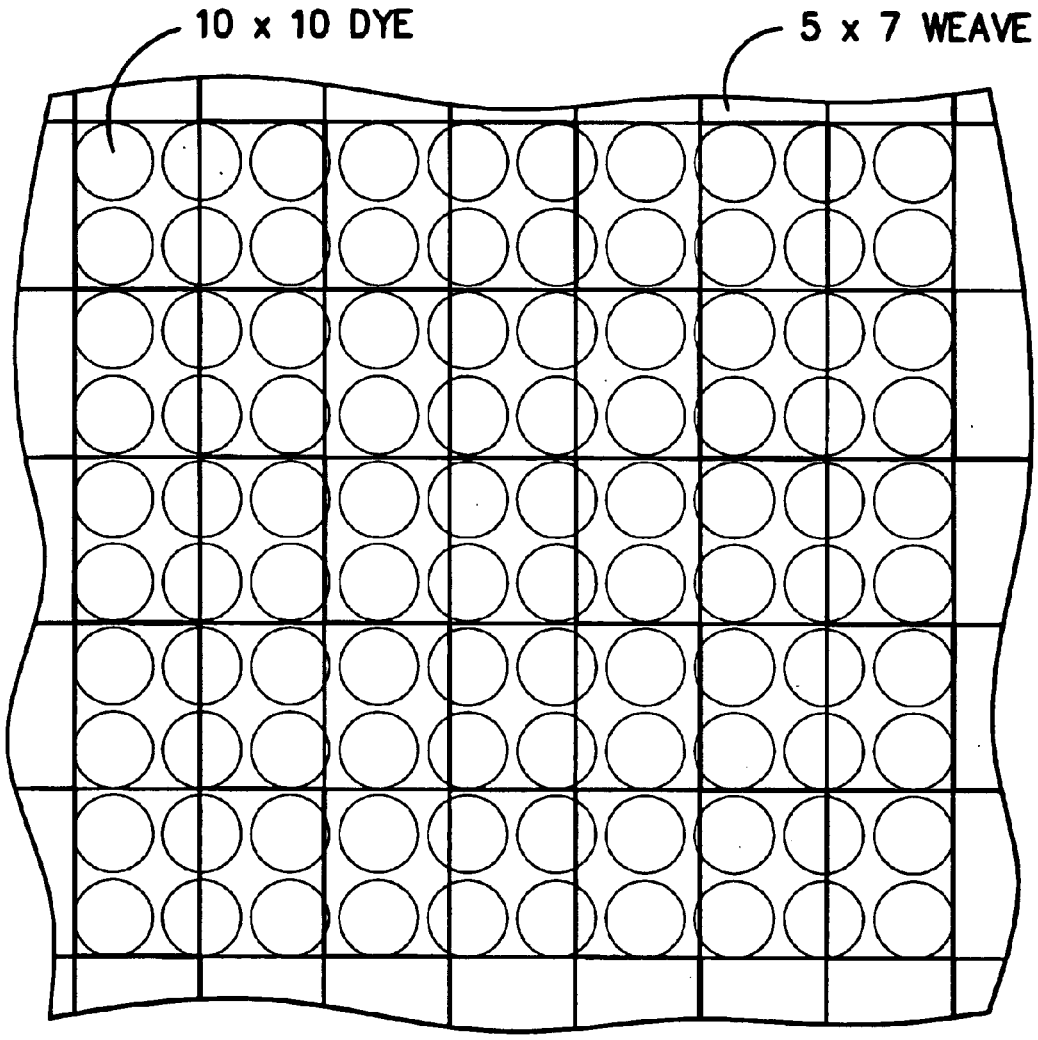
FIG. 4 is a schematic view illustrating a different weave and print pattern, for example a 5×7 weave and a 10×10 DPI print with the print pattern being independent of the weave pattern.

With reference to FIG. 4 of the drawings, there is shown a 5×7 weave pattern and a 10×10 DPI print pattern which is independent of the weave pattern.

Figure 5:
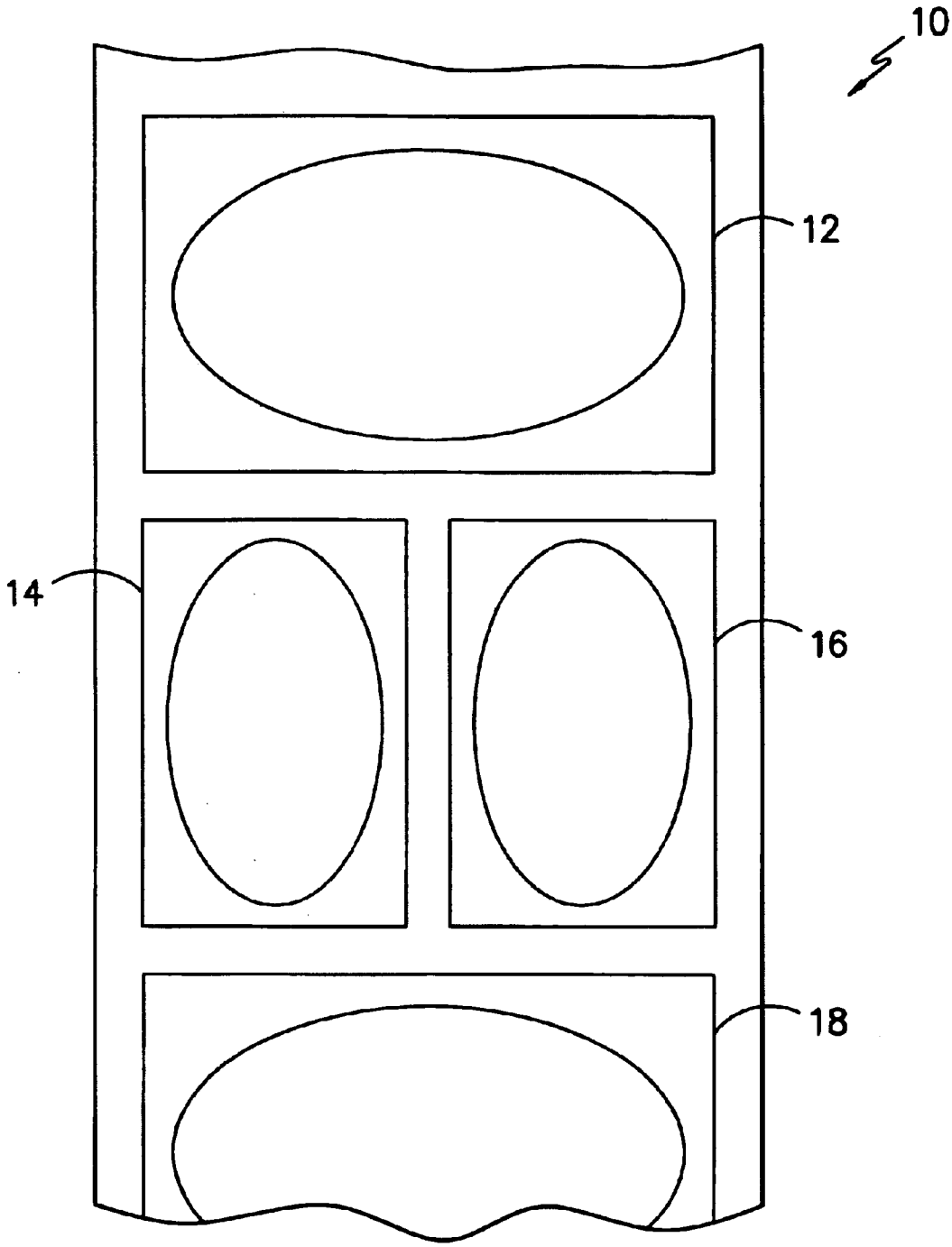
FIG. 5 is a schematic view representing a length of woven carpet substrate (base) with designs printed thereon in different orientations, although the woven carpet has a constant weave construction over its length.

As shown is FIG. 5 of the drawings, an unlimited variety of elements can be created on a single piece of woven carpet substrate or base, for example, the area rug designs or patterns 12, 14, 16 and 18 on the woven substrate 10. This maximizes the efficiency of the process, minimizes cost, and provides for mass customization where the manufacturer, designer, printer, or the like can provide orders for one a or more items from a multitude of different customers one right after the other without shutting down the machinery.

Figure 6:
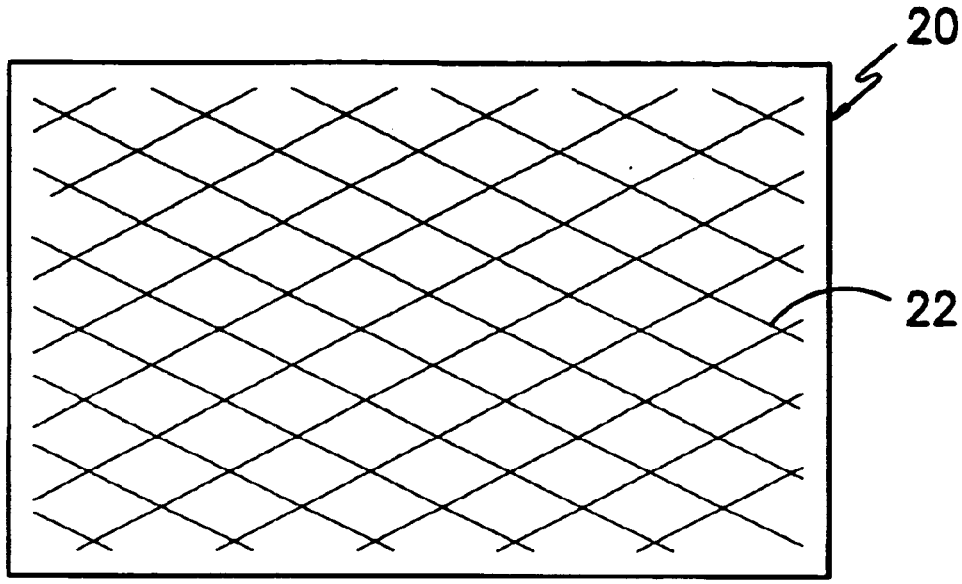
FIG. 6 is a schematic view illustrating a piece of carpet or area rug having a pattern printed thereon in accordance with the present invention.

With reference to FIG. 6 of the drawings, there is shown flooring 20, such as, a rug, carpet, area rug, or the like having a design 22 printed or dyed thereon.

Figure 7:
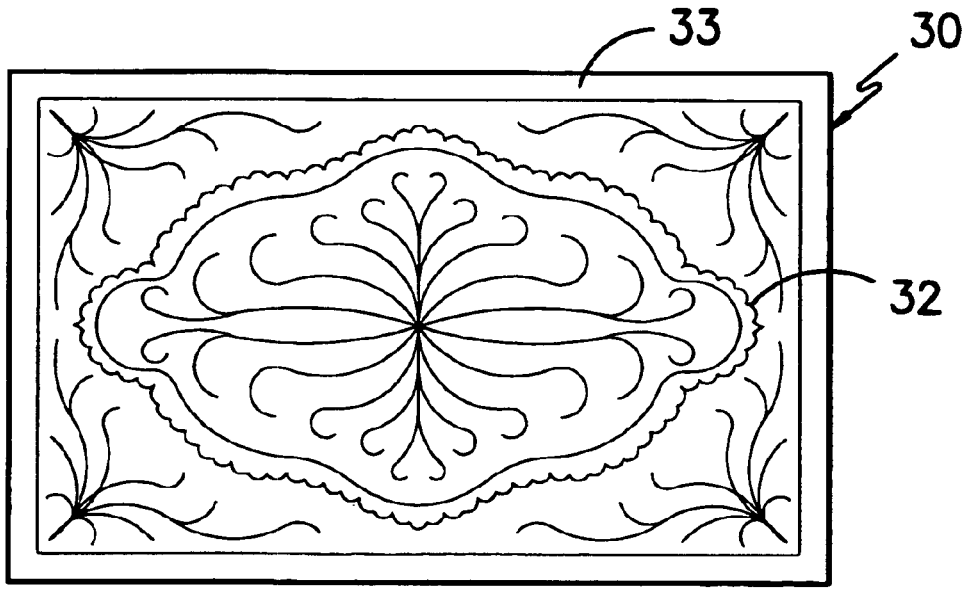
FIG. 7 is a schematic view representing an area rug or carpet having a pattern printed thereon and also including a frame-like border printed thereon to provide for slight variations in registration of the design verses the cut of the rug from the woven substrate.

With respect to FIG. 7 of the drawings, there is shown flooring 30, such as, an area rug or runner having a design 32 and an edge or border 33 printed thereon. By printing an edge or frame-like border 33 on the rug 30, and making the border of sufficient width, the manufacturer can accommodate slight variations in the registration of the design and the cutting equipment so that a customer will not notice if the design is slightly off registration or if the cut is slightly off of its intended location.

In accordance with the present invention, pattern, design, or the like is applied by means of a jet dye process, or any other secondary or post pattern application process, including but not exclusively transfer printing, silk screen printing and rotary printing, etc., to a woven carpet, where the yarn in the carpet is all white (no dye applied) or where yarn is treated chemically or where the yarn is pre-dyed with a single or multiple colors. The woven carpet can be made with any conventional loom weaving process or hand weaving process, for example Wilton, Axminster, Spool, Spool Gripper and Chenille looms, hand gun tufted, or any other method or methods of weaving carpet.

In accordance with another embodiment of the present invention, there is provided an undyed (all white) woven carpet that has a Sisal-like look, (see FIGS. 1, 2 and 16) and using a post-dye technique, pattern is applied (various design/motif elements) to it (FIGS. 8, 9, and 17–21).

Methodology a) The construction of the woven carpet substrate, may be achieved in any of the following ways, but not to the exclusion of other methods not herein sited that would infringe on the spirit of the invention. The carpet substrate can be created using many various weaving techniques, for example but not exclusively, Wilton Looms, Axminster Looms, spool looms, hand looms, tufting equipment or any other methods of creating a woven carpet product (see FIGS. 10–15 and 22–24) The carpet produced resembles natural Sisal, Raffia, grass, or other natural basket type weaves. The construction of the warp and weft could be but not exclusively a "Flat-Weave" loop type construction (See FIGS. 8, 9, and 16)

b) The fiber and yarn constituents, i.e. the warp, weft and filler yarns (see FIGS. 10, 11, 22, 23, and 24) can be of any type, such as a natural, synthetic, or blend, for example but not exclusively, wool, nylon, cotton, polypropylene, in any combination or blending.

c) The fiber or yarns may be chemically or physically treated to cause them to behave differently when colored dyes are applied to them, for example, two yarns are used in a weave and one yarn is chemically treated to make it slightly more resistant to the dye colors than the other (see FIG. 24), thereby producing a different shade of color than the other untreated yarn. These white, undyed yarns are then woven in various dithered and striayed combinations, which produce an overall subliminal or secondary pattern effect when the dyes are applied to create the primary pattern (See FIG. 25).

d) A pre or post fluid dye or over-flow applicator can also be used in combination with any of the above methodologies to create washes of color either before or after the application of the pattern. An example would be a tea-stain effect.

e) Finally, the product which can be any combination of, a), b), c) or d), is presented to a post dyeing process such as but not limited to direct or indirect jet dyeing, screen printing, rotary printing, heat transfer, or any other post dyeing process that applies pattern to carpet (See FIGS. 1–9) and various designs or pattern styles are applied to the yarns.

f) This methodology is used to produce, broadloom carpet, area rugs, accent rugs, bath mats, door mats, carpet tile, and the like.

g) Finishing in the case of the Sisal-like product being made into area rugs, accent rugs and bath mats, a secondary backing may be applied such as but not limited to a rubber or latex type which would give the product certain attributes such as non-skid and washable qualities.

Old Convention

The method of achieving a patterned sisal product with conventional methods was to hand-paint a Sisal carpet or rug, or use a limited color creel on the loom which allows for very limited color in the Sisal weave

Advantages of the New Convention

Economies of mass production, speed of new product development, delivery to market, more reliable quality and repeatability, and a greater diversity of style and offering.

In other words, conventional hand or machine woven sisal mats, carpets and rugs are hand painted with acrylic paints or made with limited color creel to produce images thereon.

One concept of the present invention is to weave a sisal-like carpet on a loom of some kind, the sisal-like carpet is woven using any post-dyeable yarn or fiber type, it is woven with undyed (white) yarn then pattern/design is applied using a jet-dye or other post dyeing pattern application process.

Another concept of the present invention is to put various design elements on a sisal-like woven product.

The present invention can maximize the economics and delivery achievable through mass production.

The present invention supports various weave constructions, yarns, fibers and dyes.

In accordance with one example, the carpet substrate is woven on a Wilton loom and dyed using a Millitron jet dye or printing machine.

In accordance with one embodiment of the present invention, machine or hand woven natural fiber mats or rugs are simulated. Among the natural fiber products that are simulated are jute fiber, palm fiber, peat, sisal, cotton, kapok, paper, coconut fiber, wood fiber, and the like.

The products of the present invention, can provide a woven, thatched, textured, or the like design or pattern.

Concept of One Embodiment of the Present Invention

To create a carpet that is woven and has a Sisal-like weave this woven carpet would start as white (undyed) carpet. It may have various yarns and fibers, i.e. nylon, wool or any other post dyeable fiber in various combinations. It may have various filler yarns, i.e. jute, cotton, polypropylene in various combinations. It may have various yarns/fibers used in combination to create the surface weave, i.e. differential dyed yarns. These are yarns that are treated in different ways so that they will receive dyes differently from each other. This can create different looks when the same color dye is applied to the differential yarns (see FIGS. 24 and 25).

The sisal-like carpet is then taken, in its undyed state and presented to a jet-dyeing, or any other kind of post-dyeing/post patterning application, including but not exclusively, inkjet printing, screen printing, rotary printing and heat transfer printing. Using any of these methods then, the carpet is transported through the process and pattern is applied to it in various colors and styles and motifs. The motifs and styles might include but not exclusively, flowers, leaves, ornament, geometric designs (see FIGS. 8, 17–21).

One Variation of this Process may be a. to apply a background shade with a post dye applicator, prior to applying pattern.
b. to use resist dyes to create the pattern and then to over dye with a post dye applicator AFTER the pattern is applied.
c. to apply a color (i.e. a weak dye which applied AFTER the pattern is applied to give a "TEA-WASH or ANTIQUED" look).

Definition

Figure 8:
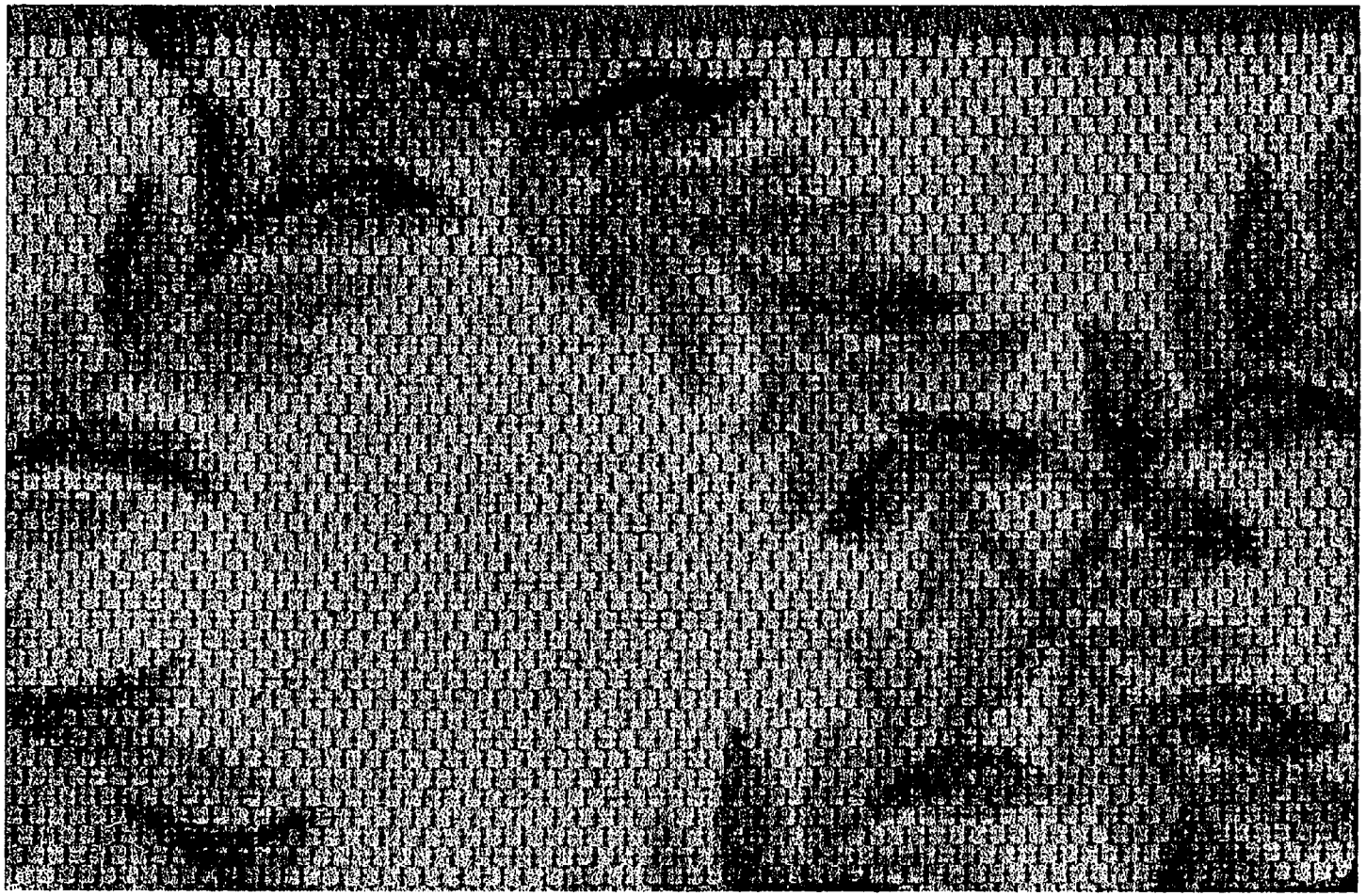
Figure 9:
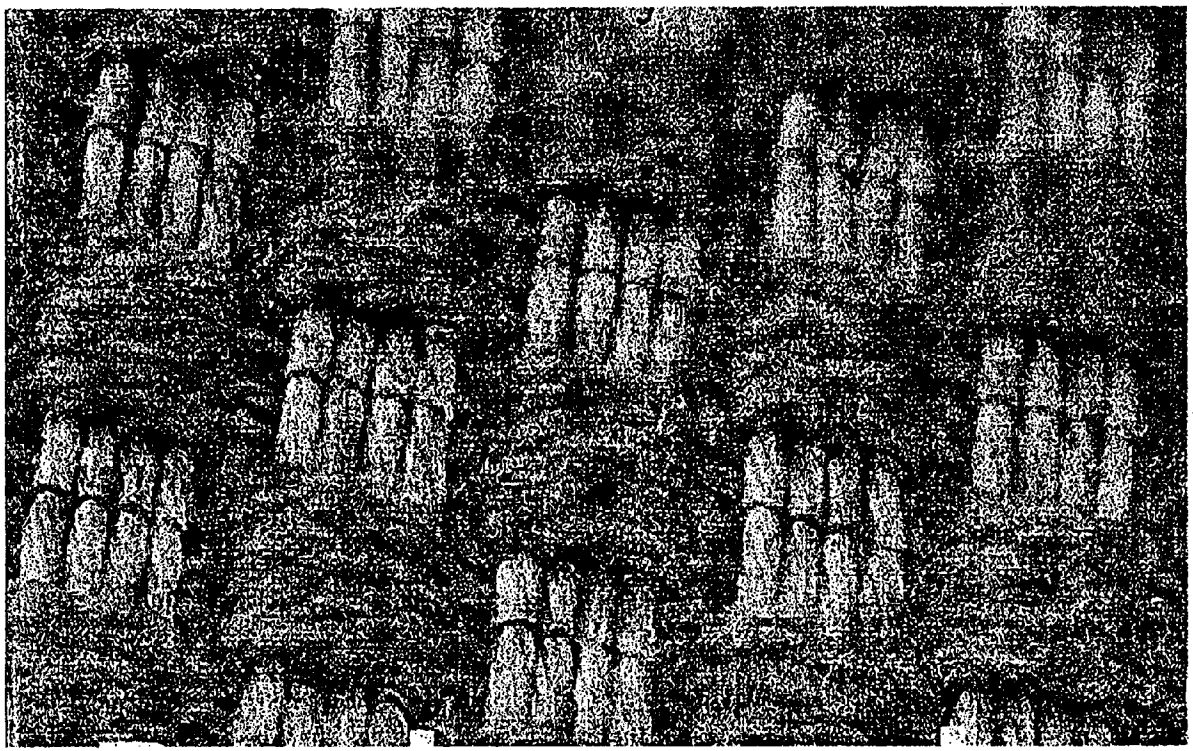
FIG. 9 is an enlarged photographic representation of a sisal-like product as shown in FIG. 8.
Figure 10:
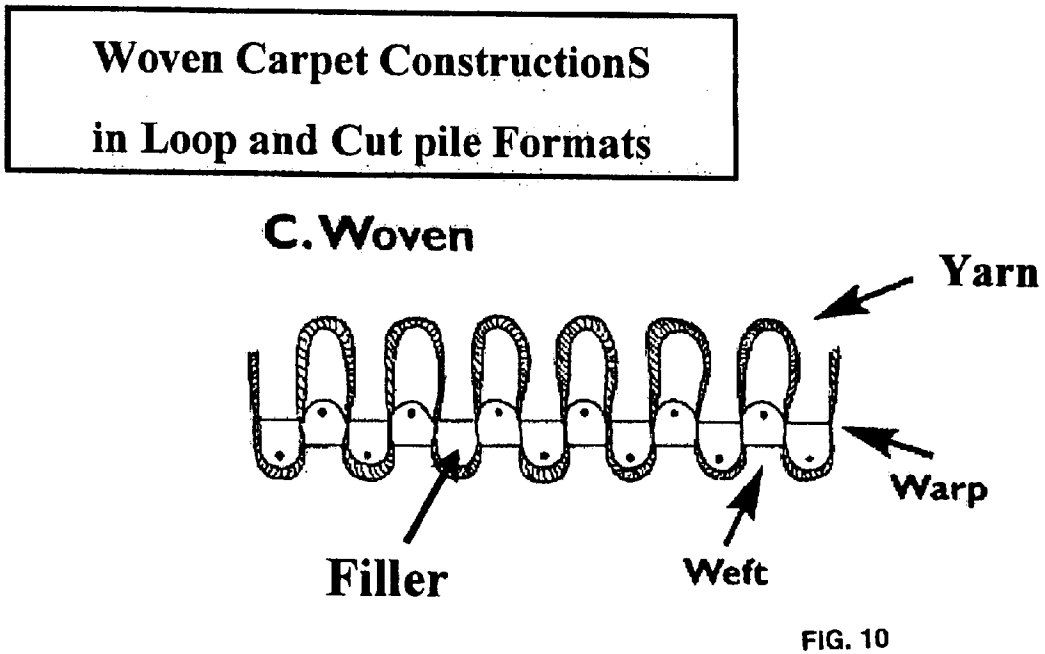
FIG. 10 is a schematic side view illustration of a loop pile woven substrate.
Figure 11:
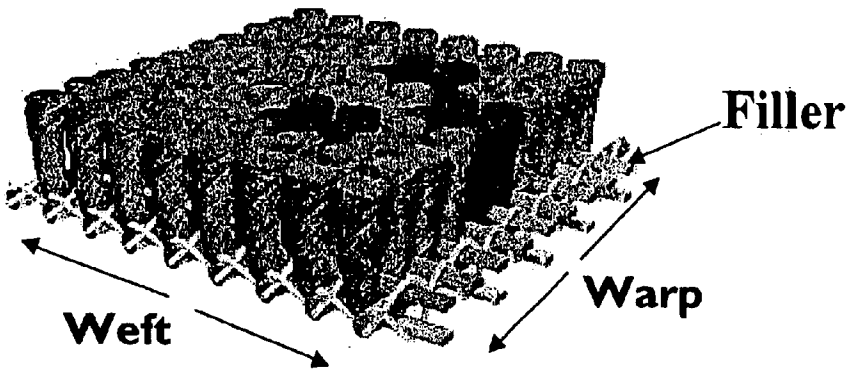
FIG. 11 is a schematic perspective view representation of a cut pile woven product.
Figures 12, 13, 14, 15:
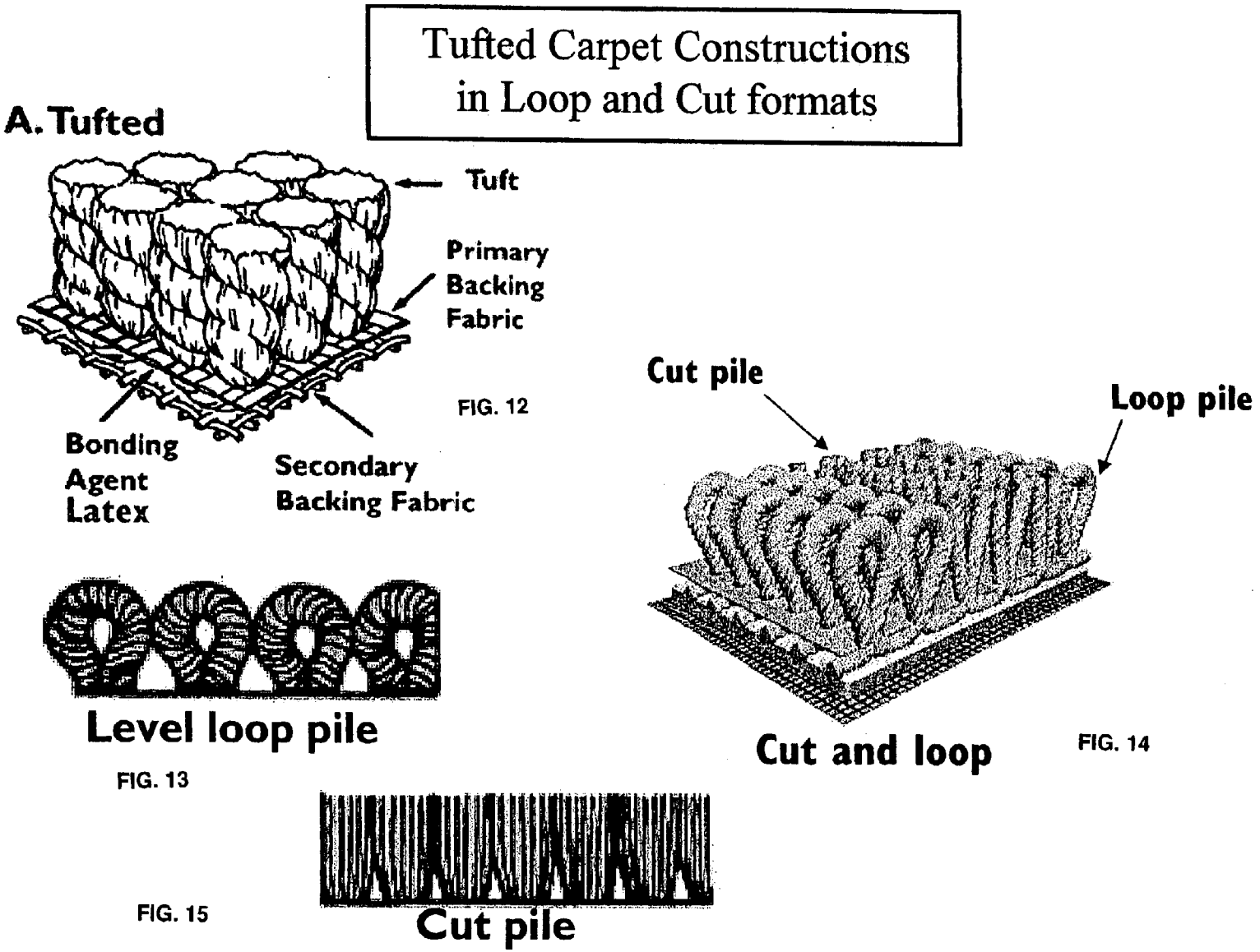
FIG. 12 is a schematic perspective view representation of a cut pile tufted substrate.
FIG. 13 is a schematic side view illustration of a level loop pile substrate.
FIG. 14 is a schematic perspective view representation of a cut and loop pile substrate.
FIG. 15 is a side view illustration of a cut pile substrate.
Figure 22:
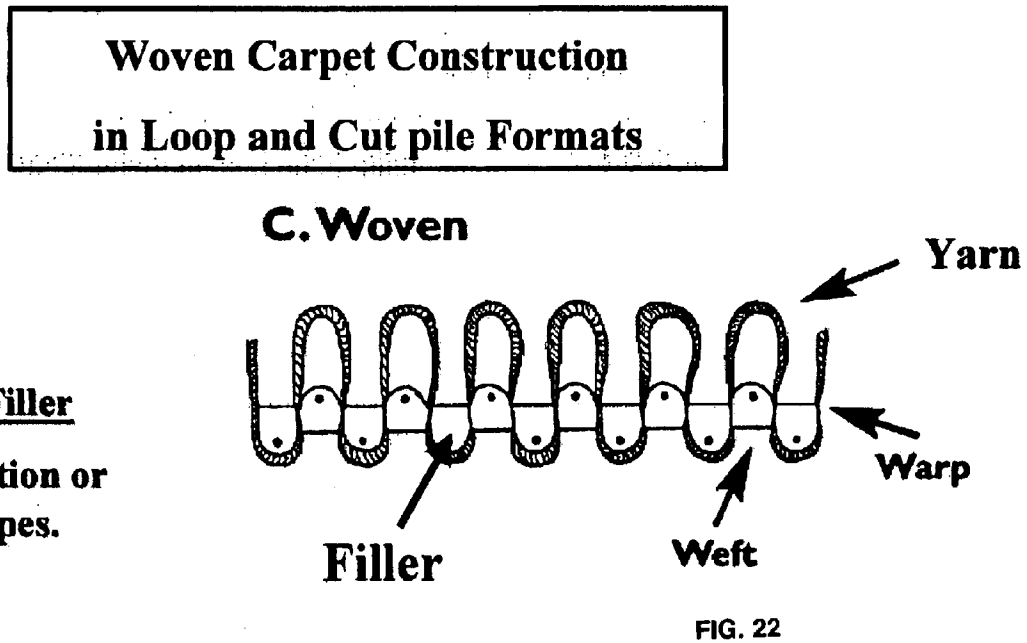
FIG. 22 is a schematic side view illustration of a loop pile woven substrate.
Figure 23:
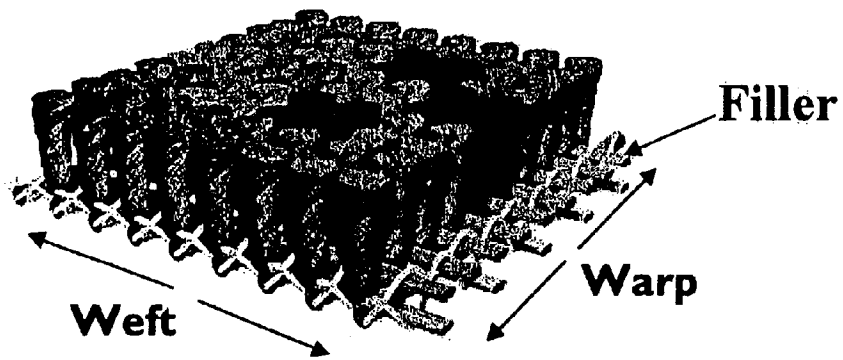

Sisal-like weave: equates to carpet that is woven on a mass producing loom where the weave of the carpet (i.e. the construction of the warp and weft) is arranged to create loops and rows of loops that resemble the various weaves of natural sisal, rafia, grass, and woven mats and rugs and broadloom (See FIGS. 8, 9, and 16). The yarn could be one of solution dyed yarn, yarn dyed, or the like and the carpet can be woven or graphics tufting.

Old Method

The only way to apply pattern to either hand-woven or machine-woven sisal is to hand-paint with acrylic paints, or use a limited color creel on the loom which allows for very limited color in the woven Sisal.

In accordance with one embodiment of the present invention, the sisal-like white woven substrate may be formed of 2 ply yarn (2/56 means 56 yards to the oz), 100% wool, 100% nylon or other post dyeable synthetic yarn, 80% nylon, 20% wool, or the like, and have a weave construction of 7×4.5, 7×5, 7×6, 7×7, 7×8, 7×9, 7×10, 7×12, etc., and may be woven from a white yarn or a solid colored yarn which can be dyed or printed (over dyed or over printed) to produce the final effect. For example, when a white yarn is used to produce a white woven carpet substrate, the background color of the rug is printed along with the design or pattern if that color is not white. Alternatively, if the yarn is a dyed or colored yarn (solution dyed, yarn dyed, naturally colored, or the like) then the design or pattern is printed thereon, but the background color is already created by the yarn itself.

With respect to FIG. 1 of the drawings, and in accordance with one embodiment of the present invention, the sisal-like carpet substrate is woven, the carpet substrate is cut into selected pieces, tiles, or the like, then each of the cut pieces dyed or printed.

With reference to FIG. 2 of the drawings and in accordance with another embodiment of the present invention, the sisal-like carpet substrate is woven, then the substrate is jet dyed with particular colors, patterns, designs, and/or the like, then particular rugs, area rugs, runners, and the like are cut from the woven dyed carpet.

Although it is preferred to dye the background color and design or pattern of the rug or carpet in a single step, as shown in FIG. 3 of the drawings and in accordance with another embodiment of the present invention, the sisal-like carpet substrate is woven, the carpet is dyed with a, for example, solid background color, then it is dyed or printed with a pattern or design, and then it is cut into rugs. Alternatively, the undyed woven substrate can have the pattern applied to it with dyes that have resist chemistry, then the background shade can be applied in line with an overflow applicator or the background shade could be applied as a separate step in a "Beck Dye" applicator.

If the end product is, for example, an area rug, one can apply an edging, ribbing, piping or surging by gluing, sewing, or otherwise attaching the edging thereto.

With reference to FIG. 4 of the drawings, there is shown a 5×7 weave pattern and a 10×10 print pattern which is independent of the weave pattern.

As shown is FIG. 5 of the drawings, an unlimited variety of elements can be created on a single piece of woven carpet substrate or base, for example, the area rug designs or patterns 12, 14, 16 and 18 on a sisal-like woven substrate 10. This maximizes the efficiency of the process, minimizes cost, and provides for mass customization where the manufacturer, designer, printer, or the like can provide orders for one a or more items from a multitude of different customers one right after the other without shutting down the machinery.

With reference to FIG. 6 of the drawings, there is shown flooring 20, such as, a rug, carpet, area rug, or the like having a design 22 printed or dyed thereon.

With respect to FIG. 7 of the drawings, there is shown flooring, such as, an area rug or runner 30 having a design 32 and an edge or border 33 printed thereon. By printing an edge or frame-like border 33 on the rug 30, and making the border of sufficient width, the manufacturer can accommodate slight variations in the registration of the design and the cutting equipment so that a customer will not notice if the design is slightly off registration or if the cut is slightly off of its intended location.

In accordance with one embodiment of the present invention, pattern, design, or the like is applied by means of a jet dye process, or any other secondary or post pattern application process, including but not exclusively transfer printing, silk screen printing and rotary printing, etc., to a sisal-like woven carpet, where the yarn in the carpet is all white (no dye applied) or where yarn is treated chemically or where the yarn is pre-dyed with a single or multiple colors. The woven carpet can be made with any conventional loom weaving process or hand weaving process, for example Wilton, Axminster, Spool, Spool Gripper and Chenille looms, hand gun tufted, or any other method or methods of weaving carpet.

With reference to FIGS. 24 and 25 of the drawings, in accordance with one embodiment of the present invention, a woven-like carpet product may be produced by treating selected yarns or yarn areas with various chemical or physical treatments so that following the dyeing thereof, the resulting carpet product has subtle color variations which give it the appearance of a woven carpet. For instance, an all-white carpet substrate (woven, bonded, or tufted) is patterned or treated with a chemical which has a certain percent resistance to dye color so that following dyeing of the carpet substrate there is produced a color variation between different yarns or different areas in the carpet. In accordance with another embodiment, certain yarns may be bright fiber and a dull fiber blended or may have a higher twist than other yarns so as to provide a different dyed color than other yarns within the carpet substrate. In accordance with a third example, a carpet substrate is made with bright fiber yarns, dull fiber yarns, blended fiber yarns, low-twist yarns, and high-twist yarns to produce color variations in the dyed pattern or design. In accordance with still another example of the present invention, a carpet substrate is chemically treated, physically treated, and/or constructed of bright fibers, dull fibers, bright fiber and dull fiber blends, twisted yarns, untwisted yarns, and the like to produce a dyed carpet product having subtle color variations which give it a woven-like appearance. Pattern or design may then be overlaid over the subtle color variation or background coloration.

The illustration in FIG. 24 merely uses different shades or colors to represent the random-type pattern created by the different yarns, chemical treatments, or the like in a carpet substrate which is typically all white. The variation in yarns or chemical treatments would usually only become visible after the post-dye application of pattern, design or color and then one would be able to visualize the subtle effect throughout the carpet.

Hence, in accordance with the present invention, it is possible to produce a woven look, sisal look, subtle color variations, and/or the like.

In accordance with another embodiment of the present invention, the rugs, area rugs, mats or the like of the present invention have a washable, skid-resistant, non-slip, non-creep, and/or the like backing, base or lower surface. For example, a washable latex backing material may be spray-coated, roller-coated, knife-coated, or the like onto the back of the carpet. Alternatively, a rubber backing may be applied by spraying, coating, or the like, or a sheet or layer of rubber may be applied using an adhesive or by vulcanizing the carpet to the rubber sheet.

In accordance with another embodiment of the present invention, carpet, broadloom carpet, rugs, mats, area rugs, or the like appear to have a woven base with a jet-dyed design, pattern, color, and/or the like thereon.

As described in U.S. Pat. No. 6,162,748 (hereby incorporated by reference), a woven face foam back floor covering may include a woven upper layer and a lower backing layer of resin, foam, adhesive, and a cover material. In accordance with the present invention, the woven upper layer may be jet-dyed or patterned.

As described in U.S. Pat. Nos. 4,522,857, 5,540,968, and 6,203,881, each hereby incorporated by reference, a stabilized cushion back carpet tile includes at least a primary carpet layer, an adhesive layer, a stabilizing layer, and a foam layer.

In accordance with another example of the present invention, a woven or woven-like appearance, carpet or substrate is bonded to a stabilized foam backing layer by an adhesive such as a resilient hot melt adhesive to form a carpet tile substrate or composite as described in above U.S. Pat. Nos. 4,522,857, 5,540,968, and 6,203,881. With reference to FIGS. 1 and 2 of the drawings, the woven or woven-like appearance carpet tile substrate or composite may be dyed before or after the carpet tile composite is cut into tiles.

While the invention has been described and disclosed in connection with certain preferred embodiments and procedures, it is by no means intended to limit the invention to such specific embodiments and procedures. Rather it is intended to cover all such alternative embodiments, procedures, and modifications thereto as may fall within the true spirit and scope of the invention.

It is, of course, to be appreciated that while several potentially preferred embodiments have been shown and described, the invention is in no way to be limited thereto, since modifications may be made and other embodiments of the principles of this invention will occur to those skilled in the art to which this invention pertains. Therefore, it is contemplated by the appended claims to cover any such modifications and other embodiments as incorporate the features of this invention within the true spirit and scope thereof.

What is claimed is:

1. A method of producing sisal-like surface texture woven flooring, comprising this steps of weaving a woven carpet substrate with a carpet yarn such that the carpet substrate comprises a plurality of interwoven carpet yarns defining a user contact surface having a sisal-like surface texture including a plurality of raised knuckles with interstitial depressors between the raised knuckles, jet dyeing a design or pattern on the woven carpet substrate by application of a plurality of cooperating dye points at a number of dots per inch (DPI) across the woven carpet; and cutting or forming the dyed or printed woven carpet substrate into a completed item or product having a sisal-like surface texture, wherein said item or product is selected from the group consisting of an area rug, runner, floor mat, carpet tile, and carpet, wherein the DPI of the applied design or pattern is greater than the number of yarns per inch of the woven carpet substrate.

2. The method as recited in claim 1, wherein the DPI of the design is at least 10×10 and the number of yarns per inch of the woven carpet is less than 10×10.

3. A flooring product produced by the method of claim 1.

4. A method of producing a flooring having a woven sisal-like surface texture, comprising the steps of:

chemically treating a woven carpet substrate having a face formed from a plurality of interwoven carpet yarns suck that said carpet substrate is adapted to absorb dyes differently in different areas of the carpet, wherein the interwoven carpet yarns define a user contact surface having a sisal-like surface texture including a plurality of raised knuckles with interstitial depressions between the raised knuckles and the number of yarns per inch of the woven carpet is less than 10×10, jet dyeing a design or patient on the treated substrate by application of a plurality of cooperating dye points at a number of dots per inch (DPI) across the woven carpet, and cutting or forming the dyed or printed substrate into a completed item or product selected from the group consisting of an area rug, runner, floor mat, carpet tile and carpet, wherein the DPI of the applied design or pattern is greater than the number of carpet yarns per inch of the carpet substrate.

5. A flaming product produced by the method of claim 4.

6. The method of claim 4 wherein the DPI of the applied design or pattern is 10×10 or greater.

* * * * *

UNITED STATES PATENT AND TRADEMARK OFFICE

CERTIFICATE OF CORRECTION

PATENT NO. : 6,884,493 B2
DATED : April 26, 2005
INVENTOR(S) : Ronald Magee and James C. Bridges It is certified that error appears in the above-identified patent and that said Letters Patent is hereby corrected as shown below:

Column 10,
Line 53, after the word "or", delete the word "patient" and insert the word -- pattern --.
Line 62, after the word "A" delete the word "flaming" and insert the word -- flooring --.

Signed and Sealed this

Ninth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,884,493 B2
DATED : April 26, 2005
INVENTOR(S) : Ronald Magee and James C. Bridges It is certified that error appears in the above-identified patent and that said Letters Patent is hereby corrected as shown below:

Column 10,
Line 46, delete “suck” and insert -- such --.

Signed and Sealed this

Thirteenth Day of June, 2006

JON W. DUDAS
*Director of the United States Patent and Trademark Office*